US007469641B2

(12) United States Patent
Berg et al.

(10) Patent No.: US 7,469,641 B2
(45) Date of Patent: Dec. 30, 2008

(54) BOLSTER AND SPRING POCKETS FOR USE WITH RAIL TRUCK

(75) Inventors: Thomas Berg, St. Louis, MO (US); Nathan Reese, Troy, IL (US)

(73) Assignee: ASF-Keystone, Inc., Granite City, IL (US)

( * ) Notice: Subject to any disclaimer, the term of this patent is extended or adjusted under 35 U.S.C. 154(b) by 237 days.

(21) Appl. No.: 11/488,270

(22) Filed: Jul. 19, 2006

(65) Prior Publication Data

US 2008/0017065 A1 Jan. 24, 2008

(51) Int. Cl.
*B61D 1/00* (2006.01)
*B61F 3/00* (2006.01)

(52) U.S. Cl. ..... 105/157.1; 105/197.05; 105/190.2

(58) Field of Classification Search ..... 105/157.1, 105/158.2, 190.2, 197.05, 185, 202, 226
See application file for complete search history.

(56) References Cited

U.S. PATENT DOCUMENTS 2,387,072 A * 10/1945 Holland et al. ..... 105/185
3,995,720 A * 12/1976 Wiebe ..... 188/33
4,760,799 A * 8/1988 Jackson et al. ..... 105/182.1
6,371,033 B1 * 4/2002 Smith et al. ..... 105/157.1
6,823,800 B2 * 11/2004 Berg et al. ..... 105/206.1
7,255,048 B2 * 8/2007 Forbes ..... 105/190.1
7,263,930 B2 * 9/2007 Pershwitz et al. ..... 105/197.05
2002/0073880 A1 * 6/2002 Wronkiewicz et al. ... 105/182.1
2006/0283351 A1 * 12/2006 Forbes et al. ..... 105/157.1
2008/0017065 A1 * 1/2008 Berg et al. ..... 105/157.1
2008/0035011 A1 * 2/2008 Forbes ..... 105/190.1

* cited by examiner

*Primary Examiner*—S. Joseph Morano
*Assistant Examiner*—Jason C Smith
(74) *Attorney, Agent, or Firm*—Edward J. Brosius

(57) ABSTRACT

A bolster for use with a rail truck assembly comprising a spring receptacle having a plurality of spring pockets on the bottom of each bolster. The bolster slidingly attached to a side frame at each end. A spring group comprising load springs and control springs, the load springs on each side frame to support and suspend the bolster end and control springs to control bolster end movement. The spring pocket adapted to retain the springs in a predetermined location and position relative to the bolster and side frame. The spring receptacle comprising spring guides intermediate the load springs and control springs to prevent tangling or interference between the springs. An angled surface on each spring guide, the angled surface forming a chamfer disposed to urge the spring into the spring pocket during installation and use.

19 Claims, 5 Drawing Sheets

BOLSTER AND SPRING POCKETS FOR USE WITH RAIL TRUCK

BACKGROUND OF THE INVENTIONS

The present invention relates generally to a bolster for use with a rail truck assembly. The bolster having a spring top receptacle comprising a plurality of spring pockets for engaging and retaining load springs in an aligned, spaced relation and predetermined arrangement. The spring receptacle for receiving the tops of springs, mounted on a respective side frame, to help with installation and to prevent the springs from becoming misaligned due to rough rail conditions.

In the railway rolling stock art, it is common practice to support the opposed ends of a freight railcar body on spaced-apart wheel-truck assemblies for travel along a railway track. A standard railcar wheel-truck assembly generally has a laterally spaced pair of side frames that are longitudinally operable along the trucks and parallel to the longitudinal axis of the railcar. A bolster, which is transversely positioned to the longitudinal direction of the railcar, couples the side frames and has the freight car body supported on bolster center plate section. A railcar wheel-truck or truck positioned at opposing ends of the railcar support the railcar during its traversal of the rail track.

Each side frame includes a window portion for receiving the bolster ends and a spring group on the side frame supporting the bolster. This structure allows bolster movement relative to the side frame. Each spring group typically includes a plurality of coil springs compressed between a side frame and the bottom of the bolster end. The bolster end is supported in spaced relation to the support platform. Elastomeric spring type products may also be utilized in a spring group as an alternative to the coil springs.

Railway track conditions can include rail running surface variations or discontinuities from differential settling of track on its ballast, rail wear, corrugations, rail misalignment, worn switch frogs or misaligned switch points, switches where switching points match with running rails, and rail joints. During normal railcar usage or operation, these and other variations can result in wheel-truck oscillations, or vibrations which may induce the railcar body to bounce, sway, rock or engage in other unacceptable motions. Wheel-truck movements transferred through the suspension system may reinforce and amplify the uncontrolled motions of the railcar from track variations, which action may result in wheel-truck unloading and a wheel or wheels of the truck may lift from the track. This unloading may cause the spring groups to disengage contact with the side frame or the bolster. The disengagement may cause the springs to fall out, become misaligned or tangled. The loss of a spring will create a dangerous situation by not having enough spring capability to support the load of the rail car. Misaligned or tangled springs may rub causing weak spots on the springs leading to a spring break creating a dangerous condition concerning supporting the rail car.

The American Association of Railroads, the AAR establishes a very severe criterion for railcar stability, wheel loading, and spring group structure. These, criteria are set or defined in recognition that railcar body dynamic modes of vibration, such as rocking of sufficient magnitude, may compress individual springs of the spring group at alternate ends of the bolster, even to a solid or near-solid condition. This alternate-end spring compression is followed by an expansion of the springs, which action-reaction can amplify and exaggerate the 'apparent' wheel loading on the suspension system and subsequent rocking motion of the railcar, as opposed to the actual or "average" weight or load from the railcar and freight therein. Because of the amplified rocking motion, and at large amplitudes of such rocking motion, the contact force of the load springs between the bolster and the side frame can be dramatically reduced on the alternate lateral sides of the railcar. In an extreme case, the springs can come loose and shift positions and tangle control springs with load spring. A misaligned or tangled spring enhances the opportunity for spring failure, derailment or increased maintenance.

There are various modes of motion of a railcar body, which is bounce, pitch, yaw, and lateral oscillation, as well as the above-noted Roll. In car body roll, or twist and roll as defined by the AAR, the car body appears to be alternately rotating in the direction of either lateral side and about a longitudinal axis of the railcar. Car body pitch is considered a forward to rearward rotational motion about a transverse railcar axis of rotation, such that the railcar may appear to be lunging between its forward and reverse longitudinal directions. The above-noted car body bounce refers to a vertical and linear motion of the railcar. Yaw is considered a rotational motion about a vertical axis extending through the railcar, which gives the appearance of the car ends moving to and fro as the railcar moves down a track. Finally, lateral stability is considered an oscillating lateral translation of the car body. Alternatively, truck hunting refers to a parallelogramming or warping of the railcar truck, not the railcar body, which is a separate phenomena distinct from the railcar body motions noted above. All of these motion modes are undesirable and can lead to unacceptable railcar performance, as well as contributing to unsafe operation of the railcar. All can be the result of inadequate or faulty spring support between the side frame and the bolster. The challenge in the suspended support of the rail car on the load springs includes maintaining the springs in an optimum position with respect to the other springs between the side frame and the bolster and keep spring separated to prevent hang up of control springs on load springs. Therefore, a need exists to separate and hold the springs in a desired alignment and support position.

SUMMARY OF THE INVENTION

It is an object of the present invention to provide a spring pocket on the underside of the bolster end for receiving each individual load spring to urge the load spring top to a predetermined aligned position with respect to the other load springs.

It is an object of the present invention to provide a control spring pocket having a spring guide for retaining and guiding the control spring top into the spring pocket during load variations and installation of the control spring.

It is a further object of the present invention to provide a load spring pocket having a locator to prevent the spring from sliding out of the spring pocket during extreme conditions of separation between the bolster and the side frame to prevent spring tangling and prevent the control springs from hanging up on the end of the load spring.

It is another object of the present invention to provide a control spring pocket surrounded by a plurality of spring guides isolate the control springs from the load springs when the spring into the pocket when the spring top is urged to move by movement of the bolster.

It is another object of the present invention to provide a spring receptacle on the bottom of the bolster comprising a plurality of spring pockets arranged in a predetermined position with respect to each other.

It is another object of the present invention to provide a spring receptacle for engaging and positioning a top of each load spring by a plurality of spring pockets having a plurality of spring guides angularly positioned around one or more of the spring pockets.

It is another object of the present invention to provide a spring receptacle having several spring pockets with a spring guide intermediate adjacent spring pockets.

It is another object of the present invention to provide a pyramid spring guide having a plurality of chamfers between the base and the tip, the pyramid spring guide intermediate a plurality of spring pockets wherein one of a plurality of chamfers on the spring guide aligns with each adjacent spring pocket.

It is another object of the present invention to provide a spring guide having a plurality of chamfers, each chamfer aligned along a radius of the adjacent spring pocket.

It is another object of the present invention to provide an arcuate shaped spring guide having a plurality of chamfers, each chamfer having a base end at a tangent to the radius of the adjacent spring pocket.

DETAILED DESCRIPTION OF THE INVENTION

Figure 1:
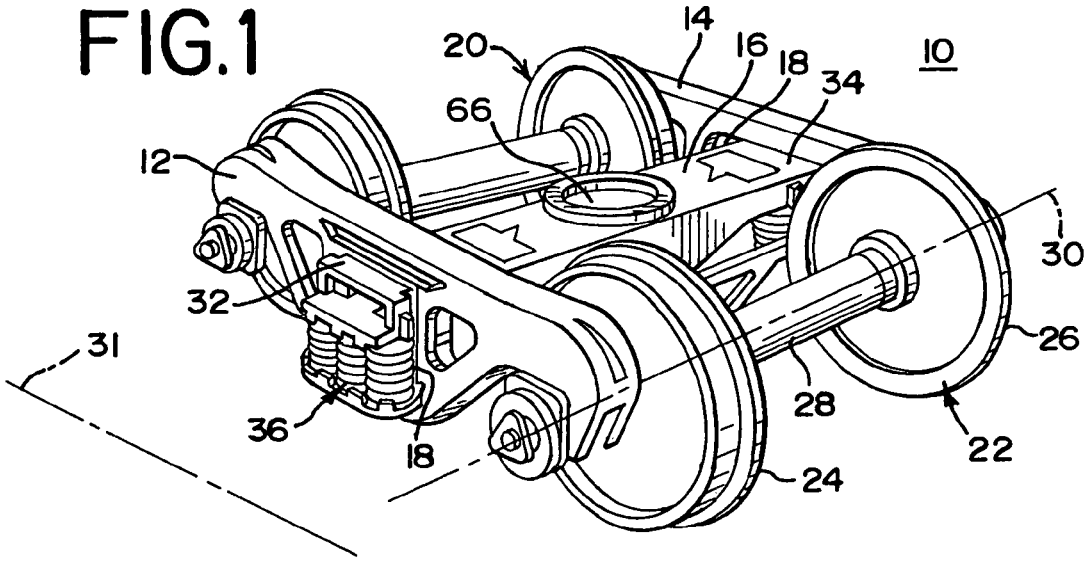
FIG. 1 is a perspective view of truck for use with a rail car.

An exemplary railcar wheel truck assembly 10, as shown in FIG. 1, has a first side frame 12 and a second side frame 14, which are arranged in parallel alignment. Each side frame 12, 14 has an inside, an outside, and a spring window 18 extending there between. Spring windows 18 are about at the longitudinal midpoint of each side frame 12, 14. Transversely connected bolster 16 couples first and second side frames 12 and 14 at their respective spring windows 18. Bolster 16 extends from the inside of the spring window 18 through each side frame 12, 14. First axle and wheel set 20 and second axle and wheel set 22 are positioned at the opposed ends of aligned side frames 12 and 14. Each of first and second axle and wheel set 20, 22 has an axle axis 30 generally transverse to the longitudinal axis 31 of first and second side frames 12, 14 and about parallel to bolster 16. Each of first and second wheel sets 20, 22 include wheels 24 and 26 and axle 28 with axle axis 30.

Continuing to refer to FIG. 1, bolster 16 has first end 32 and second end 34, which respectively extend through spring windows 18 of first and second side frames 12 and 14. The bolster first end 32 is slidingly connected to the first side frame 12 and supported by a spring group 36. Likewise, the second bolster end 34 is slidingly connected to the second side frame 14 at window 18. The support of the bolster 16 (FIG. 1) is most effective when the springs are vertically mounted between the side frame 12 and the bolster end 32 and held in a predetermined arrangement.

Figure 2:
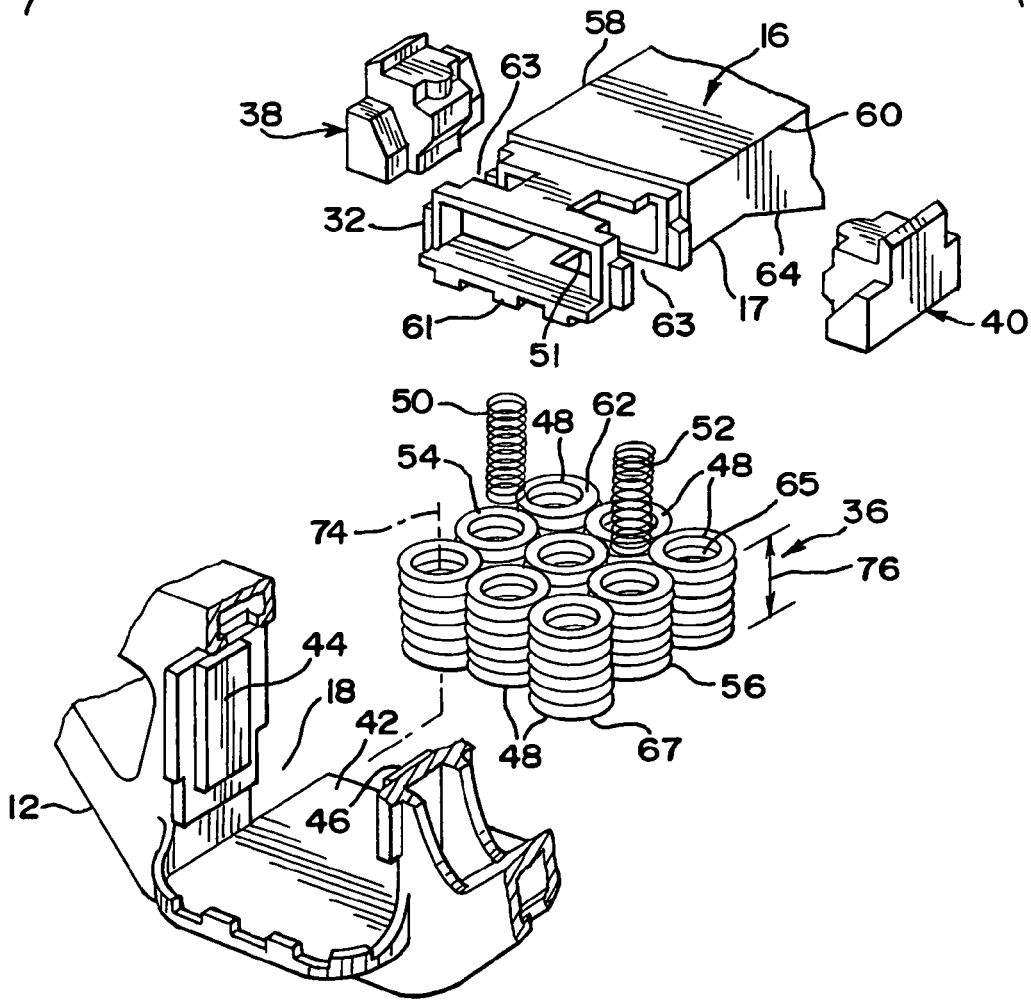
FIG. 2 is an exploded view of bolster end- and side frame.

Window 18, bolster end 32, spring group 36, first friction shoe 38 and second friction shoe 40 of side frame 12 are shown in FIG. 2 in an enlarged, partially sectioned and exploded view. As bolster ends 32 and 34, and first and second side frames 12, 14 are structurally and functionally similar, only bolster end 32 at first side frame 12 will be described, but the description is also applicable to bolster end 34 and spring window 18 on second side frame 14. The spring group 36 comprises a plurality of load springs 48, and control springs 54, 56. Each one of the plurality of load springs 48 in the spring group 36 bears against the bolster 16 to hold the bolster end 32 in spaced relation to the support platform 42. Each of the control springs 54, 56 engages and bears against friction shoes 38, 40 to limit and control train car movement with respect to the side frames 12, 14.

Referring to FIG. 2, spring window 18 has lower support platform 42 with first and second upright side columns or side faces 44 and 46, respectively, extending vertically from platform 42 and a top 45 (FIG. 1). Spring group 36 is shown as a three by three matrix of load springs 48, and control springs 54 and 56. In this matrix, first inner control spring 50 and second inner control spring 52 are concentrically positioned in outer control springs 54 and 56, respectively, to provide control spring subassemblies. Load springs 48, or load spring subassemblies may include 2 or 3 individual springs concentrically arranged in a manner to meet design criteria or to provide optimum dynamic performance of suspension spring group 36.

Bolster end 32 in FIG. 2 has spring receptacle 51 on the bolster bottom 17. Spring receptacle 51 includes lugs 61 and tapered bottom surface 64 forming a bolster chamfer adjacent the innermost spring pockets 96. Friction shoe pockets 63 receive first and second friction shoes 38 and 40, respectively, for sliding operation therein and in cooperation with side faces 44. 46. The control springs 50 and 52 apply a biasing force to friction shoes 38, 40 to cause frictional contact with side frames 44, 46 to resist movement between the bolster end 32 and side frame 12.

Continuing to refer to FIG. 2, the load springs 48 are cylindrical shaped having an axis 74 and a height 76. The load springs 48 are arranged in a predetermined spaced pattern to bear against the support platform 42 and support the bolster 16 at bolster end 32. The control springs 54, 56 are positioned in the middle row to extend into the shoe pockets 63. Each load spring 48 has a top 62, bottom 67, and a cavity 65 opening to the top 62.

Figure 3:
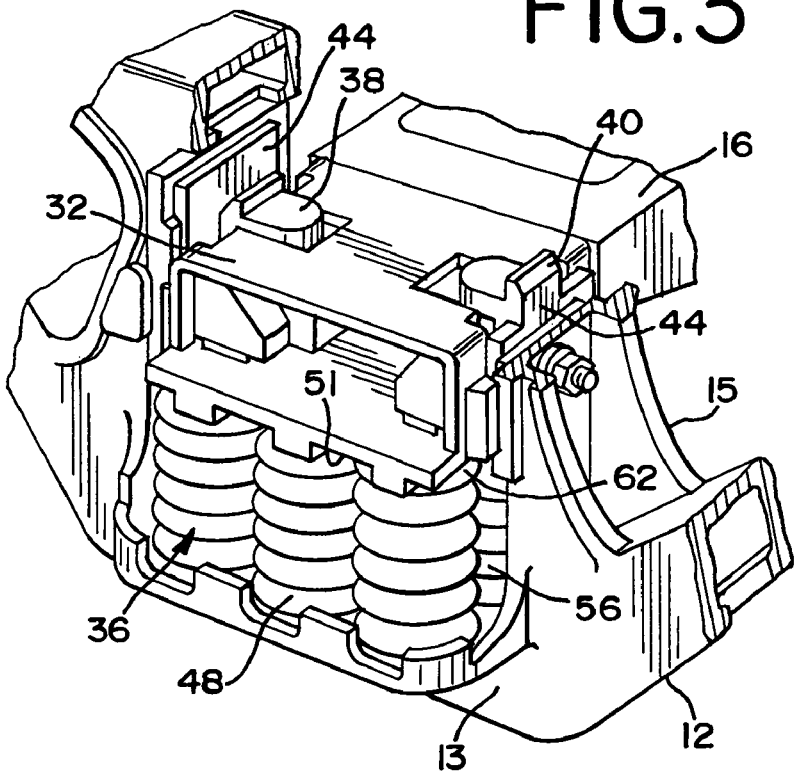
FIG. 3 is a perspective view of a bolster attached to a side frame and supported by a spring group on a support shelf.

Referring now to FIG. 3, the bolster end 32 is shown having a sliding attachment to side frame 12. This sliding attachment allows the bolster end 32 to move vertically within the spring window 18. Spring group 36 supports the bolster end 32. Spring group 36 is on the spring support 42 and bears against the spring receptacle 51 on bolster end 32. In normal operation of a freight railcar, spring group 36 biases bolster 16 and, thus, the freight railcar supported by bolster 16 at center plate 66 (FIG. 1). The biasing force controls or accommodates the oscillations or bouncing of the railcar, maintains railcar stability during traversal of the rail tracks and dampens any perturbations from various indeterminate influences, as noted above.

Figure 4:
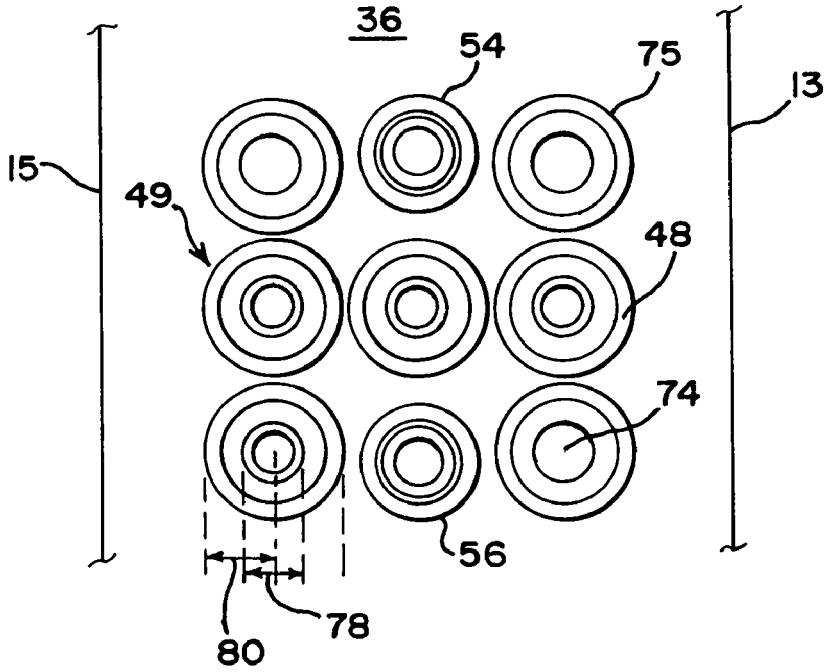
FIG. 4 is a top plan view of a spring group in spaced relation and arranged in a predetermined pattern.

Referring now to FIG. 4 The springs 48, 54, 56 in spring group 36 are preferably positioned in spaced, parallel relation to the other springs 48, 54, 56 in an array 49 as shown in FIG. 4. Each one of the plurality of springs in spring group 36 has an axis 74 and a cavity diameter 78 and an outside spring radius 80. In the preferred arrangement 49, the axis 74 of each load spring 48 is parallel to the axis 74 of the other load springs 48 and vertically oriented. The load springs 48 are separated from the control springs 54, 56.

Figure 5:
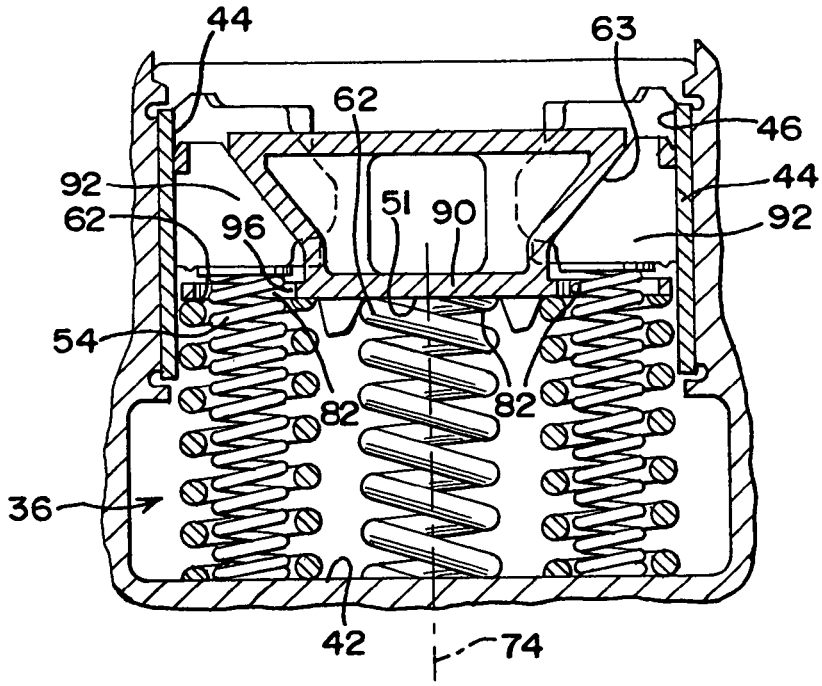
FIG. 5 is a section view of a spring group supporting the bolster end of the present invention.
Figure 7:
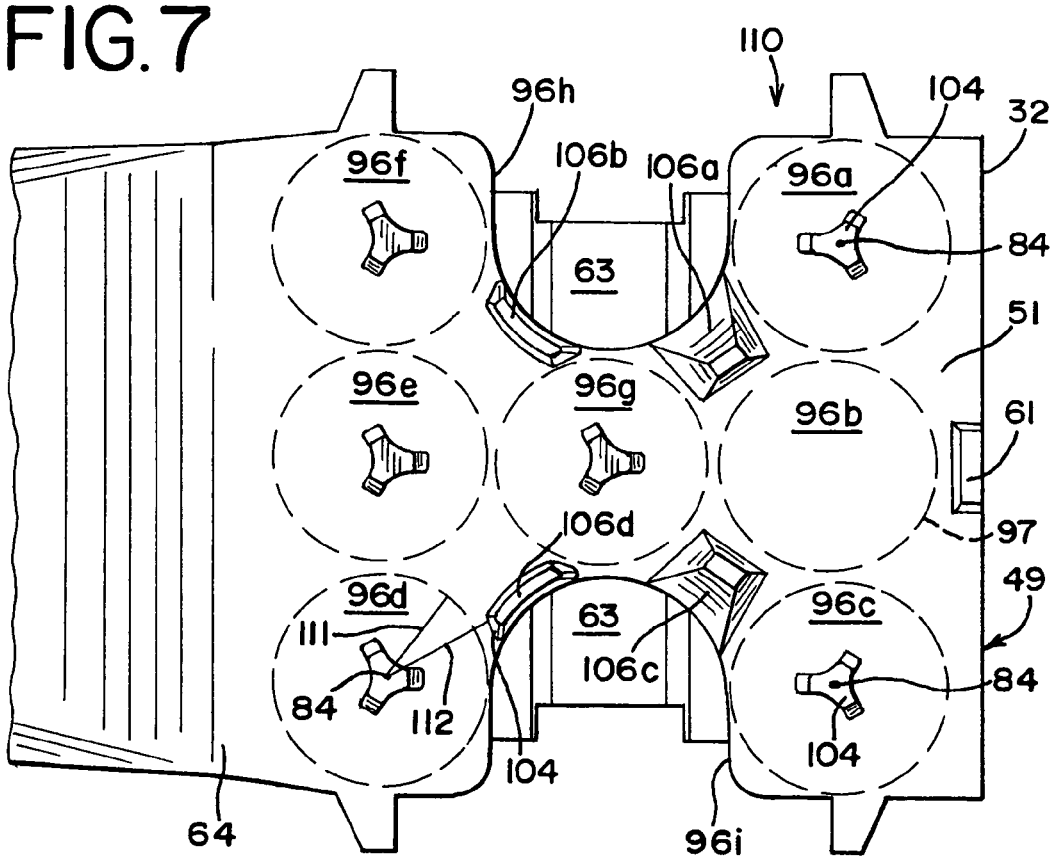
FIG. 7 is a bottom plan view of the bolster end showing the spring pockets arranged on the spring receptacle in accordance with the present invention.

Referring now to FIG. 5, a side cut away view of the bolster end 32 sectioned at a line through each control spring 54, 56 is shown. The spring group 36 sits on the support platform 42 and extends upward to the individual spring tops 62 on and bearing against the spring receptacle 51. The load springs 48 springingly support the bolster end 32 in spaced relation to the support platform 42. The spring guides 106 extend downward from the spring receptacle 51 intermediate the adjacent springs. Each spring top 62 is adapted to fit in a spring pocket 96 (FIG. 7). The control springs 54, 56 are adapted to interface with the friction shoes 38, 40 by an opening 105 in the spring pocket 96. The opening 105 extends through the bolster bottom 51 and into the shoe pockets 63.

Figure 6:
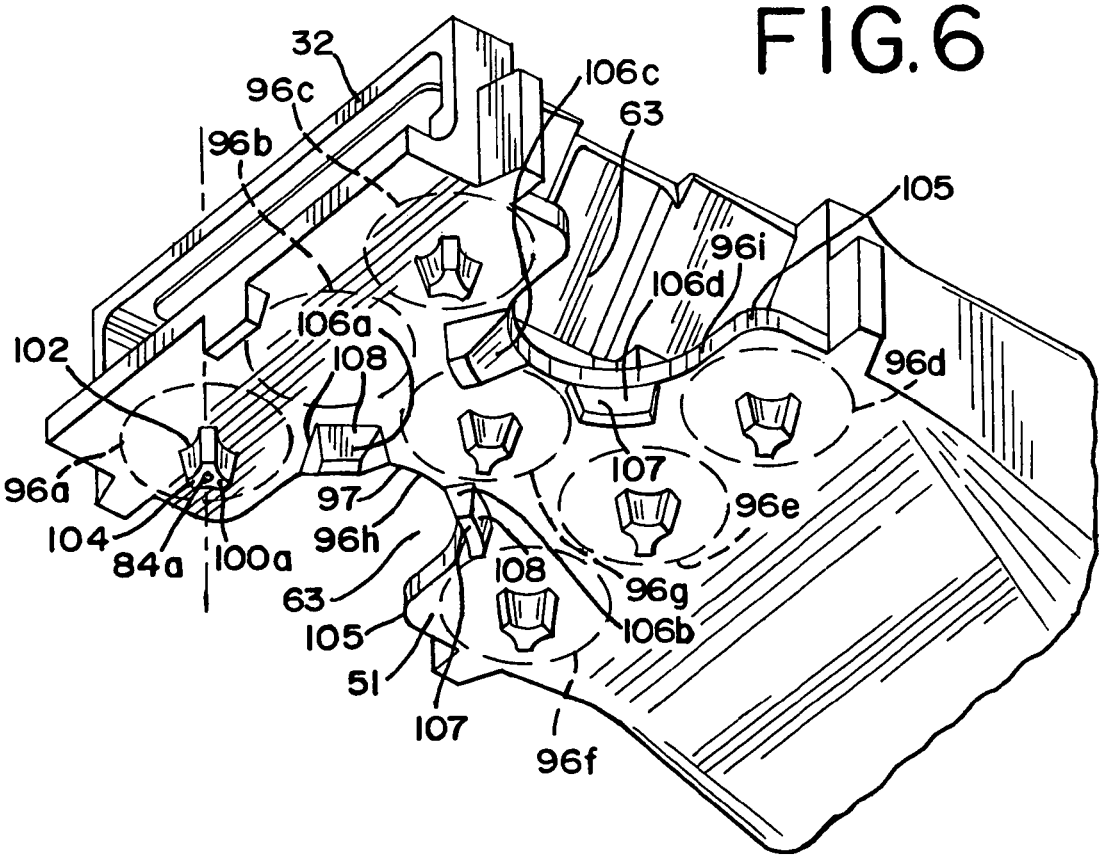
FIG. 6 is a perspective view of the bottom of a bolster end having a spring receptacle of the present invention.

Referring to FIG. 6, the spring receptacle 51 has a plurality of spring pockets 96 shown in outline. A first spring pocket 96*a* comprises a first spring locator 100*a* positioned on a center point 84*a* located at the center of first spring pocket 96*a*. The spring locator 100*a* is adapted to slidingly fit into the spring cavity 65 (FIG. 2) of the respective load spring 48. The spring locator 100*a* has a base 102 on the spring receptacle 51. The spring locator has a tip 104 spaced from the spring receptacle 51 to position the spring locator 100 hanging downward from the spring receptacle to receive the spring top 62 (FIG. 2). The spring receptacle 51 is configured for seven similar load spring pockets 96 having three outboard spring pockets 96*a*, 96*b*, and 96*c* adjacent to bolster end 32 and three inboard spring pockets 96*d*, 96*e*, 96*f* and a center spring pocket 96*g*. The spring receptacle is also adapted for two control spring pockets 96*h*, 96*i*. Control spring pockets 96*h* and 96*i* extend into the respective shoe pocket 63. First spring guide 106*a* has a pyramid shape and is positioned intermediate spring pocket 96*h* and adjacent load spring pockets 96*a*, 96*b* and 96*g*. First spring guide 106*a* has a plurality of chamfers 108, the chamfers are adapted to each face an adjacent spring pocket 96*a*, 96*b*, 96*g*, 96*h*. Similarly, second spring guide 106*b* is positioned intermediate adjacent spring pockets 96*e*, 96*f*, 96*g*, and 96*h*. Second spring guide 106*b* is inboard from first spring guide 106*a* and adapted to a crescent moon shape having the concave surface 107 facing the control spring pocket 96*h*. Second spring guide 106*b* also has convex side 109 facing adjacent spring pockets 96*f*, and 96*g*.

Continuing to refer to FIG. 6, spring receptacle 51 has similarly positioned third spring guide 106*c* and fourth spring guide 106*d* surrounding control spring pocket 96*i*. Referring to FIG. 4 and FIG. 6 together, each spring guide, referred to in general as 106, is outside the respective adjacent spring pocket 96*i*, 96*h* to protect the control spring 54, 56 from interference by a load spring 48 (FIG. 4). Each spring guide 106 has a chamfer facing the adjacent spring pocket. As shown referring to first control spring pocket 96*h* the arcuate ridge shaped spring guide 106*b* has a concave wall comprising a chamfer 107 partially concentric with the perimeter 97 of control spring pocket 96*h* and a convex surface 108 extending from a position adjacent the center spring pocket 96*g* to a position adjacent the inboard spring pocket 96*f* to provide a chamfer portion or gradient facing each adjacent load spring pocket 96*g*, 96*f*.

Referring to FIG. 7, a bottom elevation view of the spring receptacle 51 shows the preferred layout 49 of the spring pockets 96 having seven load springs 48 (FIG. 2) and two control springs 54, 56 (FIG. 2). The spring pockets 96 are shown in outline having a perimeter 97 to illustrate the non-overlapping array 49 layout. Spring locators 104 are positioned at the center point 84 of each load spring pocket except pocket 96*b*. Load spring pocket 96*b* is surrounded by spring guide 106*a* and 106*c* and lug 61. As shown on spring pocket 96*d*, the spring pocket has a pocket radius 111 having a length larger than the outside spring radius 80. (FIG. 4). Furthermore, the base 114 of spring guide 106*d* is spaced from center point 84 by chamfer radius 112. Chamfer radius 112 is larger than outside spring radius 80.

Figure 8:
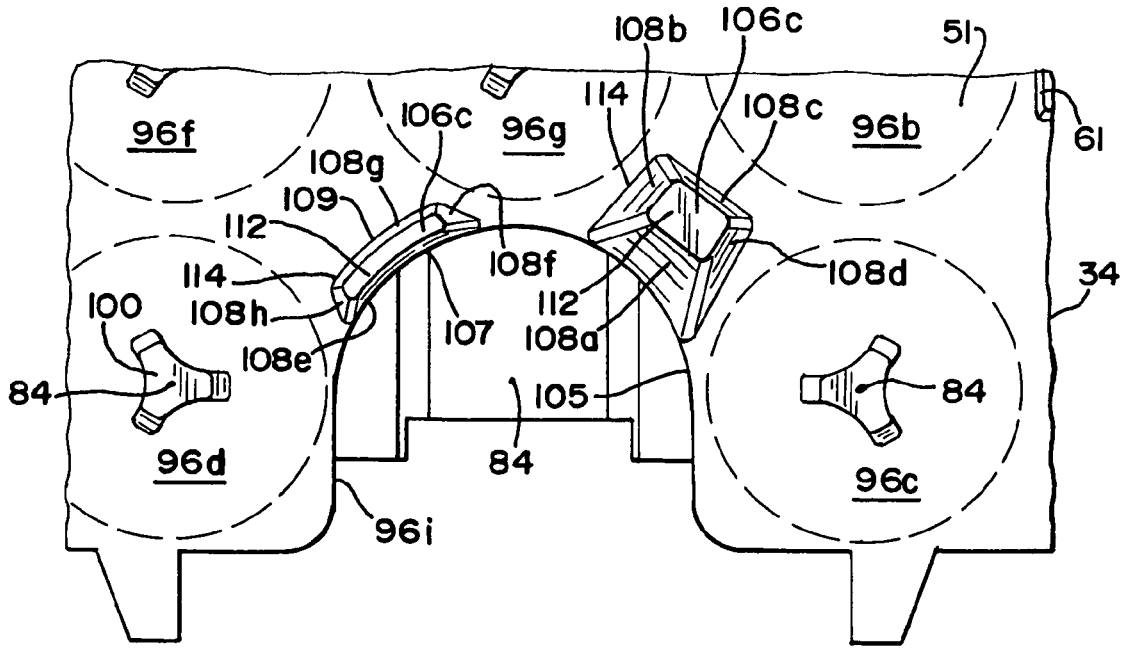
FIG. 8 is a bottom plan view of a control spring pocket.

Referring to FIG. 8, control spring pocket 96*i* is shown in detail. It should be understood, control spring pocket 96*h* is similarly configured in mirrored relation to control spring pocket 96*i*. Third spring guide 106*c* has a first chamfer 108*a* facing control spring pocket 96*i*, a second chamfer portion 108*b* facing load spring pocket 96*g*, a third chamfer portion 108*c* facing load spring pocket 96*b* and fourth chamfer portion 108*d* facing load spring pocket 96*c*. Spring guide 106 has a base 114 and a tip 112. Each chamfer portion extends from the base 114 toward the tip 112. The junction of the base 114 and the chamfer 108 is outside the adjacent spring pocket 96. Fourth spring guide 106*d* has an arcuate shape having a concave side 107 adjacent the control spring pocket 96*i* and a convex side 109. The convex side 109 extends from a position facing center spring pocket 96*g* to a point adjacent spring pocket 96*c*. The convex side 109 has a sloping shape coming up from the base 114 and away from the adjacent spring pockets 96*d* and 96*g*. Fourth spring guide 106*d* has a base 114 from which the concave 107 and convex 109 sides depend. Fourth spring guide 106*d* has a concave chamfer portion 108*e* surrounding control spring pocket 96*i*, second convex chamfer portion 108*f* adjacent center load spring pocket 96*g* and third chamfer portion 108*g* facing load spring pocket 96*f*. Fourth chamfer portion 108*h* faces load spring pocket 96*d*.

Figure 9:
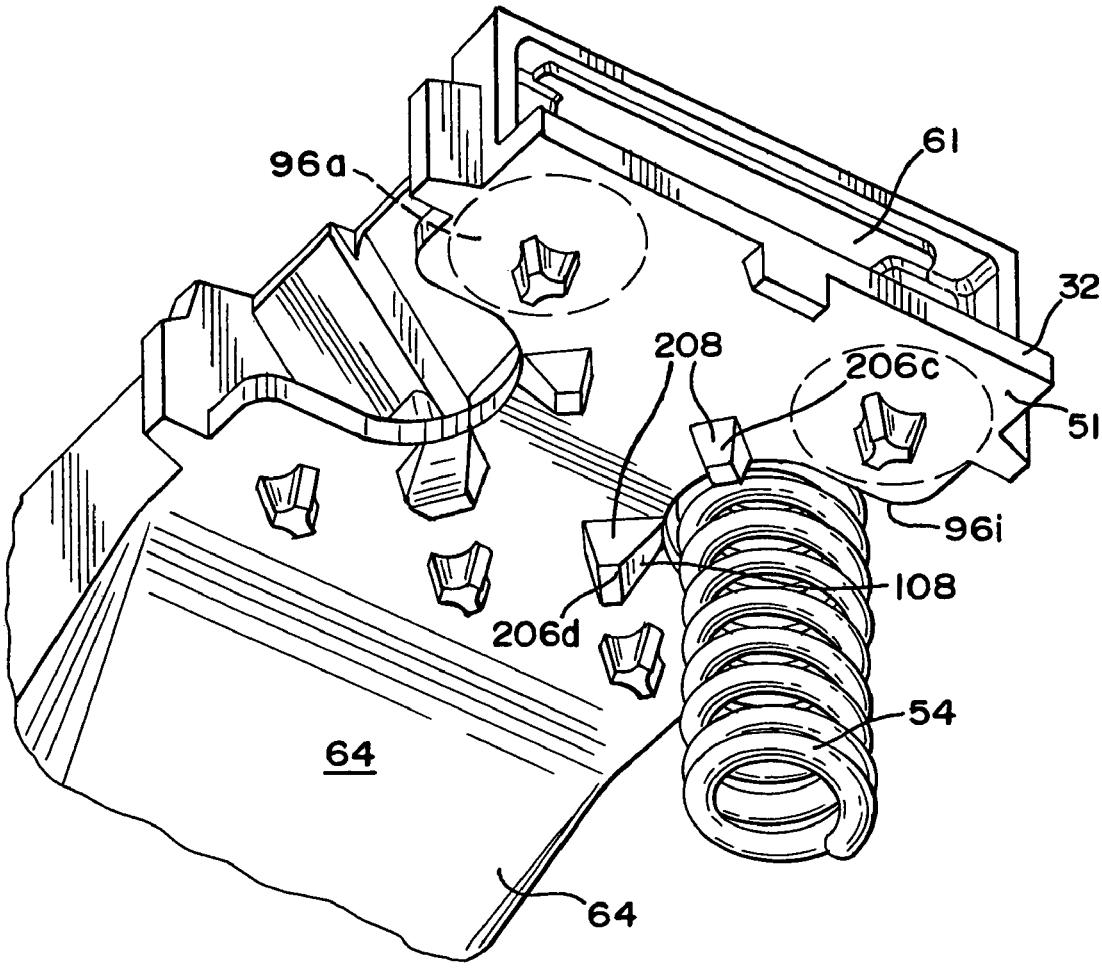
FIG. 9 is a perspective view of a second embodiment of a bolster end in accordance with the present invention.

Referring to FIG. 9 the spring receptacle 51 is shown having control spring 54 typically positioned in spring pocket 96*i*. An alternate configuration of spring guides 206 is shown as a second embodiment of the present invention. The spring guide 206 mass is calculated to allow bolster end 32 to flex. As should be understood, a large spring guide will stiffen the bolster end 32 making it more likely to break under load rather than flex. The spring guides 206 are spaced from the control spring 54 to allow non-impeded compression and extension of control spring 54. Spring guides 206 have chamfers 208 facing adjacent spring pockets 96.

In use, the spring guides 106 help with installation of the springs 48, 54, and 56. The springs 48, 54, 56 are pre-compressed and inserted in the spring window 18 between the bolster 16 and the side frame 12, 14. The spring guides help installer urge the spring top 62 into the respective spring pockets 96. During use, the spring pocket 96 is the predetermined location for the top 62. The spring pockets 96 on the spring receptacle 51 retain the top 62 of the springs 48, 54, 56 to hold the spring group 36 in a symmetrical or desired arrangement as shown in FIGS. 2,3,4 and 5. The springs 46, 54,56 will compress and extend as the bolster ends 32, 34 move with respect to the side frames 12, 14. The bolster 16 is attached to the rail car (not shown) at plate 66 (FIG. 1). The railcar weight at either an unloaded or a fully laden weight causes spring compression. However, for any particular railcar, the railcar weight is a variable with a broad range extending from an empty-car, vehicle tare weight to a loaded-to-capacity railcar, and perhaps loaded above the rated, vehicle weight. As the railcar traverses the track on wheels 24, 26 (FIG. 1), it experiences dynamic compressive forces on the springs 48, and it is susceptible to all the above-cited track flaws as well as countless others, which could contribute to undamped oscillations causing excitation of the springs 48. Springs 48, 54, 56 are held in parallel, spaced relation to provide the requisite damping and support to the railcar and wheel-truck assembly 10 for its safe operation. However, though the super elevated curves partially alleviate some railcar operational problems, other significant operational problems for railcar operation remain or are created as a result of operating through these curves causing unloaded springs that may be urged by vibrations or jolts to the wheels 24, 26 (FIG. 1) to move with respect to each other on the bolster end 32 and the spring support shelf 42. The spring receptacle 51 is adapted to receive and retain each spring top 62 in a respective spring pocket 96. The spring pocket 96 represents the respective spring's location in the spring array 49 (FIG. 4). The spring locator 100 slidingly mates in cavity 65 and the spring guides 106 bear against the top 62 at the outer edge 75 (FIG. 4) to urge the spring top 62 to stay in the spring pocket 96. The spring top 62 in the spring pocket 96 helps the springs 46, 54,56 maintain the spaced, parallel, relation to optimize support performance and to minimize wear and damage due to misaligned springs. It should be understood, the second end 34 of the bolster 16 is similarly configured as the first end 32.

First bolster end 32 has at least one load spring 48 and at least one control spring 54 between the first spring receptacle and the first side frame. The control spring 54 has a top 62 (FIG. 3) in a load pocket 96 (FIG. 7) having spring guides 106 spaced at predetermined angles around a perimeter 97 of the first control spring pocket and intermediate the adjacent load spring pocket 96. The second bolster end 34 has a similar configuration having at least one load spring between the second end 34 at second spring receptacle 51 and the second side frame 14. The load spring 48 has a top 62 in a load spring pocket 96 on the spring receptacle 51 on the second end 34. The spring guides 106 are spaced at predetermined angles around a perimeter of the second spring pocket 96. Additional spring pockets 96 with or without spring locators 106 may be configured on each spring receptacle 51. First spring receptacle 51 on bolster end 32 is configurable with control spring pockets 96*h*, 96*i* for receiving control springs 54, 56. control spring pockets 96*h*, 96*i* extend into the shoe pocket 63 through opening 105 for interface with friction shoes 38, 44. Friction shoes 38, 40 prevent extreme movement between the bolster 16 and the side frame 14. The control spring pockets 96*h*, 96*i* each have a plurality of spring guides 106 located outside the respective perimeter 97 to help with installation and to prevent the control spring from jumping out of the spring pocket. As should be understood, the movement of the rail car with respect to the side frames 12, 14 causes a loading and unloading of the spring group 36 which may cause the individual springs 48, 54 and 56 to move with respect to each other. The spring pockets 96 (FIG. 6, 7, 8) and associated spring guides 106 urge the spring tops 62 to stay in spring pockets 96 (FIG. 6) on the spring receptacle 51 to keep the springs in spaced and preferably parallel relation to each other in a vertical position on the support platform 42.

Each of the spring pockets is defined by a desired pocket perimeter and a centerpoint. If a spring locator is in the pocket, it is positioned on the centerpoint. The spring locator comprising a projection extending downward from the spring receptacle adapted to slidingly fit in the cavity of the respective load spring in the spring pocket, Although the invention has been described above in connection with particular embodiments and examples, it will be appreciated by those skilled in the art that the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

What is claimed:

1. A railway truck comprising:

a first side frame, and a second side frame, each side frame having a front end, a rear end, and a spring window formed intermediate the front end and the rear end, the spring window having a support platform, a first and second side column on the support platform, the first side column adjacent the front end, a second side column on the support platform adjacent the rear end, the first and second side columns spaced from each other, and a top traversing the first and second side columns, the top spaced from the support platform;

a spring group on the support platform, the spring group comprising at least one load spring and at least one control spring on the first side frame, each spring having a top, a bottom, an outside, an inside, and a cavity defined on the top of the load spring extending to the inside, the spring bottom on the support platform;

a bolster having first end, a second end, and a bottom, the bolster first end in the spring window of the first side frame, the bolster first end slidably connected to the first side frame, the second end in the spring window of the second side frame, the second end slidably connected to the second side frame;

a spring receptacle on the first end, a control spring pocket on the spring receptacle, the top of the control spring in the control spring pocket, a first spring guide on the spring receptacle, the spring guide having a chamfer adjacent the control spring pocket, the chamfer adapter to urge the control spring into the control spring pocket, and wherein the first spring guide further comprises a base and a tip, the base on the spring receptacle, the tip spaced from the base, the chamfer depending from the base.

2. The invention of claim 1 wherein the first spring guide further comprises a plurality of chamfers depending from the base.

3. The invention of claim 2 further comprising a load spring pocket, the load spring pocket adjacent to the control spring pocket and separated by the spring guide intermediate the load spring pocket and the control spring pocket, one of the plurality of chamfers adjacent to and facing the load spring pocket.

4. The invention of claim 1 further comprising a load spring pocket, the load spring pocket adjacent the control spring pocket, the spring guide tip intermediate the control spring pocket and the load spring pocket.

5. The invention of claim 4 further comprising a second spring guide on the spring receptacle, the second spring guide intermediate the control spring pocket and the load spring pocket, the second spring guide having first chamfer adjacent the control spring pocket and a second chamfer adjacent the load spring pocket.

6. The invention of claim 4 wherein first spring guide comprising an arcuate shaped ridge extending from the spring receptacle, the first spring guide having a concave side partially surrounding the first control spring pocket and a convex side adjacent the load spring pocket.

7. The invention of claim 6 further comprises a second control spring pocket adjacent the load spring pocket, an arcuate shaped spring guide on the spring receptacle having a convex side adjacent the load spring.

8. A railway truck comprising:

a first side frame having a spring support platform and a spring window a plurality of load springs and a plurality of control springs, the load springs and control springs arranged in an array, each spring in the plurality of load springs having a bottom on the support platform and a top, each spring in the plurality of control springs having a bottom on the support platform and a top, a bolster having a first end, a second end and a bottom, the first end slidably attached to the first side frame, the first end in the spring window;

a spring receptacle on the bottom of the bolster at the first end, the top of each spring in the plurality of load springs on the spring receptacle, the spring receptacle comprising a first and second control spring pocket, the first control spring pocket comprising a first opening through the bottom of the bolster, the opening defining a perimeter of the first control spring pocket, the top of one of the plurality of control springs in the opening, the second control spring pocket comprising a second opening through the bottom of the bolster, the second opening defining a perimeter of the second control spring pocket, the top of a second one of the plurality of control springs in the second opening;

a first spring guide comprising a tip, a base on the spring receptacle and a chamfer depending from the base, a chamfer adjacent to the perimeter of the first control spring pocket, a second spring guide comprising a base on the spring receptacle, a tip and a chamfer depending from the base, the chamfer adjacent to the perimeter of the second control spring pocket.

9. The invention of claim 8 wherein the first spring guide further comprises a first arcuate shaped wall comprising a tip, a base on the spring receptacle and a concave chamfer extending from the base, the chamfer adjacent to and partially surrounding the perimeter of the first control spring pocket, the second spring guide further comprises a second arcuate shaped spring guide comprising a base on the spring receptacle, a tip and a concave chamfer between the base and the tip, the second spring guide adjacent to and partially surrounding the perimeter of the second control spring pocket.

10. The invention of claim 9 further comprising a first pyramid spring guide adjacent to the perimeter of the first control spring pocket, the first pyramid spring guide having a base on the spring receptacle, a tip and chamfer, the chamfer depending from the base adjacent to the perimeter of the first control spring pocket, the chamfer extending toward the tip, a second pyramid spring guide on the spring receptacle adjacent to the perimeter of the second control spring pocket, the second pyramid spring guide having a chamfer, a base and a tip, the base on the spring receptacle, the chamfer depending from the base adjacent the perimeter of the second control spring pocket.

11. The invention from claim 10 further comprising a center load spring pocket, the load spring pocket having a center point, a perimeter, a pocket radius, the center load spring pocket intermediate the first and second control spring pocket, the first arcuate shaped spring guide having a chamfer portion depending from the base of the first arcuate spring guide adjacent to the load spring pocket perimeter, the second arcuate shaped spring guide having a chamfer portion depending from the base of the second arcuate spring guide adjacent to the load spring pocket perimeter, the first and second arcuate shaped spring guides spaced from each other.

12. The invention of claim 11 wherein each of the plurality of load springs further comprises an outer radius, tips spaced from the center point by a tip radius, the spring radius having a length smaller that a length of the pocket radius, the pocket radius having a length smaller than a length of the tip radius.

13. A railway truck comprising:

a first side frame, and a second side frame, each side frame having a front end, a rear end, and a spring window formed intermediate the front end and the rear end, the spring window having a support platform, the first and second side column on the support platform, the first side column adjacent the front end, a second side column on the support platform adjacent the rear end, the first and second side columns spaced from each other, and a top traversing the first and second side columns, the top spaced from the support platform;

a spring group on the support platform, the spring group comprising a plurality of load springs and a first and second control spring, each load spring having a top, a bottom, an outside, an inside, a spring radius and a cavity on the top, the spring bottom on the support platform, the control springs having a bottom and a top, the bottom of the control springs on the support platform, the springs arranged in an array comprising a line of outboard load springs, a line of inboard load springs, a first center load spring between the inboard line and the outboard line, a first control spring intermediate the inboard line and outboard line, the first control spring adjacent to the first side column, a second control spring intermediate the inboard line and the outboard line, the second control spring adjacent to the second side column;

a bolster having a first end, a second end, and a bottom, a pair of shoe cavities opening to the bottom of the bolster adjacent each end, the bolster first end in the spring window of the first side frame, the bolster first end slidably connected to the first side frame, the second end in the spring window of the second side frame, the second end slidably connected to the second side frame;

a spring receptacle on the first end, a plurality of load spring pockets on the spring receptacle, the load spring pockets arranged in the array of the load springs, each of the plurality of load spring pockets adapted to receive the top of one of the plurality of load springs on the support platform, a first control spring pocket on the spring receptacle comprising a perimeter, the top of the first control spring in the first control spring pocket, a second control spring pocket on the spring receptacle comprising a perimeter, the top of the second control spring in the second control spring pocket;

a first plurality of spring guides on the spring receptacle, each spring guide of the first plurality spaced from other spring guides of the first plurality, the first plurality of spring guides adjacent to the perimeter of the first control spring pocket, each spring guide having a chamfer adjacent the first control spring pocket, a second plurality of spring guides on the spring receptacle, each spring guide of the second plurality spaced from other spring guides of the second plurality, the second plurality of spring guides adjacent to the perimeter of the second control spring pocket, each one of the second plurality of spring guides having a chamfer adjacent the second control spring pocket whereby the springs are received in a respective spring pocket on the spring receptacle to hold the springs in a predetermined spaced relation to each other, the control springs isolated from the load springs by spring guides disposed around the perimeter of each control spring pocket.

14. A railway truck comprising:

a first side frame, and a second side frame, each side frame having a front end, a rear end, and a spring window formed intermediate the front end and the rear end, the spring window having a support platform, a first and second side column on the support platform, the first side column adjacent the front end, a second side column on the support platform adjacent the rear end, the first and second side columns spaced from each other, and a top traversing the first and second side columns, the top spaced from the support platform;

a spring group of the support platform, the spring group comprising at least one load spring and at least one control spring on the first side frame, each spring having a top, a bottom, an outside, an inside, and a cavity defined on the top of the load spring extending to the inside, the spring bottom on the support platform;

a bolster having a first end, a second end, and a bottom, the bolster first end in the spring window of the first side frame, the bolster first end slidably connected to the first side frame, the second end in the spring window of the second side frame, the second end slidably connected to the second side frame;

a spring receptacle on the first end, a control spring pocket on the spring receptacle, the top of the control spring in the control spring pocket, a first spring guide on the spring receptacle, the spring guide having a chamfer adjacent the control spring pocket, the chamfer adapted to urge the control spring into the control spring pocket, and further comprising a second spring guide on the spring receptacle, the second spring guide spaced from the first spring guide and adjacent the control spring pocket, the second spring guide having a first chamfer adjacent the control spring pocket.

15. The invention of claim 14 further comprising a load spring pocket on the spring receptacle, the first and second spring guide intermediate the control spring pocket and the load spring pocket.

16. The invention of claim 14 wherein the load spring pocket further comprises a perimeter, the first and second spring guides intermediate the perimeter and the control spring pocket, a chamfer portion on the first spring guide adjacent the perimeter.

17. The invention of claim 14 further comprising a second control spring pocket on the spring receptacle, the second control spring pocket spaced from the first control spring pocket, a third spring guide on the spring receptacle intermediate the load spring pocket and the second spring pocket, the third spring guide having a chamfer facing the second control spring pocket.

18. The invention of claim 17 further comprising a fourth spring guide on the spring receptacle, the fourth spring guide on the spring receptacle adjacent to the second control spring pocket, the fourth spring guide having first chamfer facing the second control spring pocket wherein the first and second spring guides partially surround the first control spring pocket, the third and fourth spring guides partially surrounding the second control spring.

19. A railway truck comprising:

a first side frame, and a second side frame, each side frame having a front end, a rear end, and a spring window formed intermediate the front end and the rear end, the spring window having a support platform, a first and second side column on the support platform, the first side column adjacent the front end, a second side column on the support platform, the first side column adjacent the front end, a second side column on the support platform adjacent the rear end, the first and second side columns spaced from each other, and a top traversing the first and second side columns, the top spaced from the support platform;

a spring group on the support platform, the spring group comprising at least one load spring and at least one control spring on the first side frame, each spring having a top, a bottom, an outside, an inside, and a cavity defined on the top of the load spring extending to the inside, the spring bottom on the support platform;

a bolster having a first end, a second end, and a bottom, the bolster first end in the spring window of the first side frame, the bolster first end slidably connected to the first side frame, and second end in the spring window of the second side frame, the second end slidably connected to the second side frame;

a spring receptacle on the first end, a control spring pocket on the spring receptacle, the top of the control spring in the control spring pocket, a first spring guide on the spring receptacle, the spring guide having a chamfer adjacent the control spring pocket, the chamfer adapted to urge the control spring into the control spring pocket, and wherein the first spring guide is a crescent moon shaped ridge having a concave side adjacent to the control spring pocket.

* * * * *